United States Patent [19]

Martin

[11] Patent Number: 5,069,039

[45] Date of Patent: Dec. 3, 1991

[54] CARBON DIOXIDE REFRIGERATION SYSTEM

[75] Inventor: Patrick S. Martin, Dallas, Tex.

[73] Assignee: General Cryogenics Incorporated, Dallas, Tex.

[21] Appl. No.: 591,386

[22] Filed: Oct. 1, 1990

[51] Int. Cl.[5] ..... F25D 21/06

[52] U.S. Cl. ..... 62/50.3; 62/156; 62/272; 62/526

[58] Field of Search ..... 62/156, 50.1, 50.2, 62/50.3, 50.4, 50.7, 526, 275, 272

[56] References Cited

U.S. PATENT DOCUMENTS

| | | | |
|---|---|---|---|
| 3,307,366 | 3/1967 | Smith | 62/50.1 X |
| 3,335,576 | 8/1967 | Phillips | 62/156 |
| 3,802,212 | 4/1974 | Martin et al. | 62/52 |
| 3,861,167 | 1/1975 | Nojo | 62/156 X |
| 4,045,972 | 9/1977 | Tyree, Jr. | 62/156 |
| 4,100,759 | 7/1978 | Tyree, Jr. | 62/165 X |
| 4,186,562 | 2/1980 | Tyree, Jr. | 62/62 |
| 4,498,306 | 2/1985 | Tyree, Jr. | 62/119 |

OTHER PUBLICATIONS

Refrigerated Containerized Transport for "Jumbo" Jets, L. Tyree, Jr., 1971, pp. 521–525.

The Refrigerant Dilemma, Kira Gould, Fleet Owner, Sep. 1989, pp. 94–100.

Cryogenic Refrigeration: Wave of the Future?, Ken Stadden, Heavy Duty Trucking, Jul. 1990, p. 128.

*Primary Examiner*—Harry B. Tanner

*Attorney, Agent, or Firm*—Crutsinger & Booth

[57] ABSTRACT

A method and apparatus to refrigerate air in a compartment wherein liquid dioxide is delivered through a first primary heat exchanger such that sufficient heat is absorbed to evaporate the liquid carbon dioxide to form pressurized vapor. The pressurized vapor is heated in an external heat exchanger to prevent solidification of the pressurized carbon dioxide when it is depressurized to provide isentropic expansion of the vapor into a secondary heat exchanger. Pneumatically driven motors are driven by the pressurized carbon dioxide vapor to move air across the heat exchangers. Orifices in inlets to the motors and solenoid valves in flow lines to the motors keep the vapor pressurized while the external heat exchanger supplies sufficient heat to prevent solidification when it expands through the motors.

16 Claims, 2 Drawing Sheets

CARBON DIOXIDE REFRIGERATION SYSTEM

TECHNICAL FIELD

The invention relates to a cryogenic refrigeration system using carbon dioxide to maintain the temperature of air in a compartment below freezing.

BACKGROUND OF INVENTION

Refrigerated transport vehicles for frozen foods such as fish, meat and ice cream must maintain a cargo compartment temperature below freezing.

U.S. Pat. No. 3,802,212 to Patrick S. Martin et al discloses a refrigeration system which utilizes liquified cryogenic gas such as liquid nitrogen or liquid carbon dioxide to control temperature in a cargo compartment in a transport vehicle. Difficulty has been encountered in systems using liquid carbon dioxide as the refrigerant because the temperature in the cargo compartment could not be maintained below approximately 30° Fahrenheit. The carbon dioxide solidified forming dry ice in the system, which required frequent defrosting. Thus, it did not have a commercially acceptable subfreezing capability.

Several patents disclose a back-pressure regulator in a liquid $CO_2$ system between an evaporator and a gas driven motor of the type disclosed in Martin et al U.S. Pat. No. 3,802,212 in an effort to prevent the formation of dry ice in the system by maintaining an operating pressure of 65 psig or higher.

Tyree U.S. Pat. No. 4,045,972 discloses improvements in Martin et al U.S. Pat. No. 3,802,212 including a temperature sensor and a back-pressure regulator installed in an effort to maintain a minimum pressure of, for example, 80 psia to prevent the formation of $CO_2$ snow which could result in blockage or at least a reduced level of operation of the refrigeration system. Three embodiments of the liquid carbon dioxide refrigeration system are disclosed and the disclosure states that the embodiment illustrated in FIG. 4 can be particularly advantageous when it is desired to achieve a cargo compartment temperature of about −20° F. The disclosure states that liquid carbon dioxide is vaporized in a first heat exchanger, passes through a back-pressure regulator and then to a gas driven motor. The gas motor and an expansion orifice in a line leading to the heat exchanger are described as being sized so that the temperature drop of the expanding vapor is limited so that carbon dioxide snow is not created.

Tyree U.S. Pat. No. 4,186,562 discloses a liquid carbon dioxide refrigeration system including a backpressure regulator in the vapor line leading from a vaporizer to maintain a minimum pressure of, for example, 75 psia for the purpose of preventing the formation of snow. The major portion of the vapor stream is described as being expanded through one or more gas motors, passed through one or more additional heat exchangers, and then vented.

Tyree U.S. Pat. No. 4,100,759 discloses a heat exchanger described as being of sufficient length so that all of the liquid carbon dioxide turns to vapor and exits through a back-pressure regulator that is set to maintain a pressure of at least 65 psig in the heat exchanger coil to prevent the formation of solid carbon dioxide. The carbon dioxide vapor flows through a gas motor drivingly connected to a blower fan that causes circulation of the atmosphere throughout the cargo compartment past the heat exchanger.

The systems using carbon dioxide as a refrigerant have not enjoyed wide spread commercial acceptance because of the tendency of carbon dioxide to solidify and "freeze-up" the system. Recent studies indicate that the atmosphere is being so severely damaged by Freon and other chloroflurocarbons (CFCs) that their use as refrigerants is being discouraged by governments worldwide. A dire need exists for a refrigeration system which uses a non-polluting refrigerant.

SUMMARY OF INVENTION

The carbon dioxide refrigeration system disclosed herein relates to improvements in refrigeration apparatus of the type disclosed in my prior U.S. Pat. No. 3,802,212, the disclosure of which is incorporated herein by reference in its entirety for all purposes. Liquid carbon dioxide is directed through evaporator coils for cooling products in a cargo compartment and carbon dioxide vapor from the evaporator is directed through a pneumatically operated motor for driving a fan to circulate air in the compartment across surfaces of the evaporator coils. $CO_2$ vapor, after passing through the evaporator coils and pneumatically driven motors, is exhausted to atmosphere.

Improvements in the system include a heat exchanger, mounted outside the vehicle to modify or control the enthalpy and entropy of the carbon dioxide by warming the $CO_2$ gas after it leaves the primary cooling coils and before it reaches the pneumatically driven motors. A pair of solenoid actuated flow control valves 225 and 226 and a pressure relief valve are mounted in the $CO_2$ line leading from the external heat exchanger. The external heat exchanger and pressure relief valve control the temperature and pressure of the $CO_2$ to assure that the $CO_2$ does not solidify when its pressure drops to near atmospheric pressure as it enters the pneumatic motors chamber.

Carbon dioxide is a colorless, odorless gas of the composition $CO_2$, which in the system hereinafter described is under an operating pressure of approximately 85 psig. If the pressure drops from 85 psig to 61 psig then the liquid carbon dioxide transforms to a solid state. On the other hand at the operating pressure of 85 psig, if temperature drops below −72° F. then the liquid carbon dioxide transforms to a solid state.

Temperature sensitive control apparatus regulates the flow rate of carbon dioxide vapor through the evaporator coils. If the temperature of carbon dioxide vapor entering the motors is too low, the control apparatus, diverts carbon dioxide through a vaporizer, mounted outside the vehicle and exposed to ambient temperature, and directs vapor from the evaporator through a heating apparatus to defrost the system or to provide winter heating. The vapor is heated to a temperature of for example 1,000° F. and delivered through the evaporator coils and the pneumatic motors to heat air circulated through the storage compartment for the heating phase.

A defrost cycle is initiated when the temperature of carbon dioxide delivered to the inlet of the pneumatic motor reaches a predetermined temperature of, for example, −70° F. When the temperature of the $CO_2$ reaches the predetermined temperature at which the $CO_2$ is at the point of passing through a phase change from vapor to liquid a defrost cycle is initiated. If the vapor is allowed to condense and become liquid, the liquid experiences a significant pressure drop as it passes through the pneumatic motor which will cause it to solidify forming dry ice which will restrict flow of carbon dioxide through the system.

The defrost cycle is terminated by the control apparatus when the temperature of the surfaces of the evaporator coils have been heated to a predetermined temperature of, for example, $-60^{\circ}$ F.

A primary object of the invention is to provide refrigeration apparatus particularly adapted to maintain subfreezing temperature in a compartment in a container or in any vehicle, such as a truck, transport trailer, railroad car, airplane or ship, which is self-contained and which utilizes liquefied carbon dioxide to refrigerate, heat and defrost a compartment without connection to an external source of power.

Another object of the invention is to provide refrigeration apparatus utilizing liquefied carbon dioxide to provide a subfreezing refrigeration capacity without altering the normal oxygen content in the compartment.

Other and further objects of our invention will become apparent by reference to the detailed description hereinafter following and to the drawings annexed hereto.

DESCRIPTION OF DRAWING

Drawings of a preferred embodiment of the invention are annexed hereto so that the invention will be better and more fully understood, in which.

Numeral references are employed to designate like parts throughout the various figures of the drawing.

DESCRIPTION OF A PREFERRED EMBODIMENT

Figure 1:
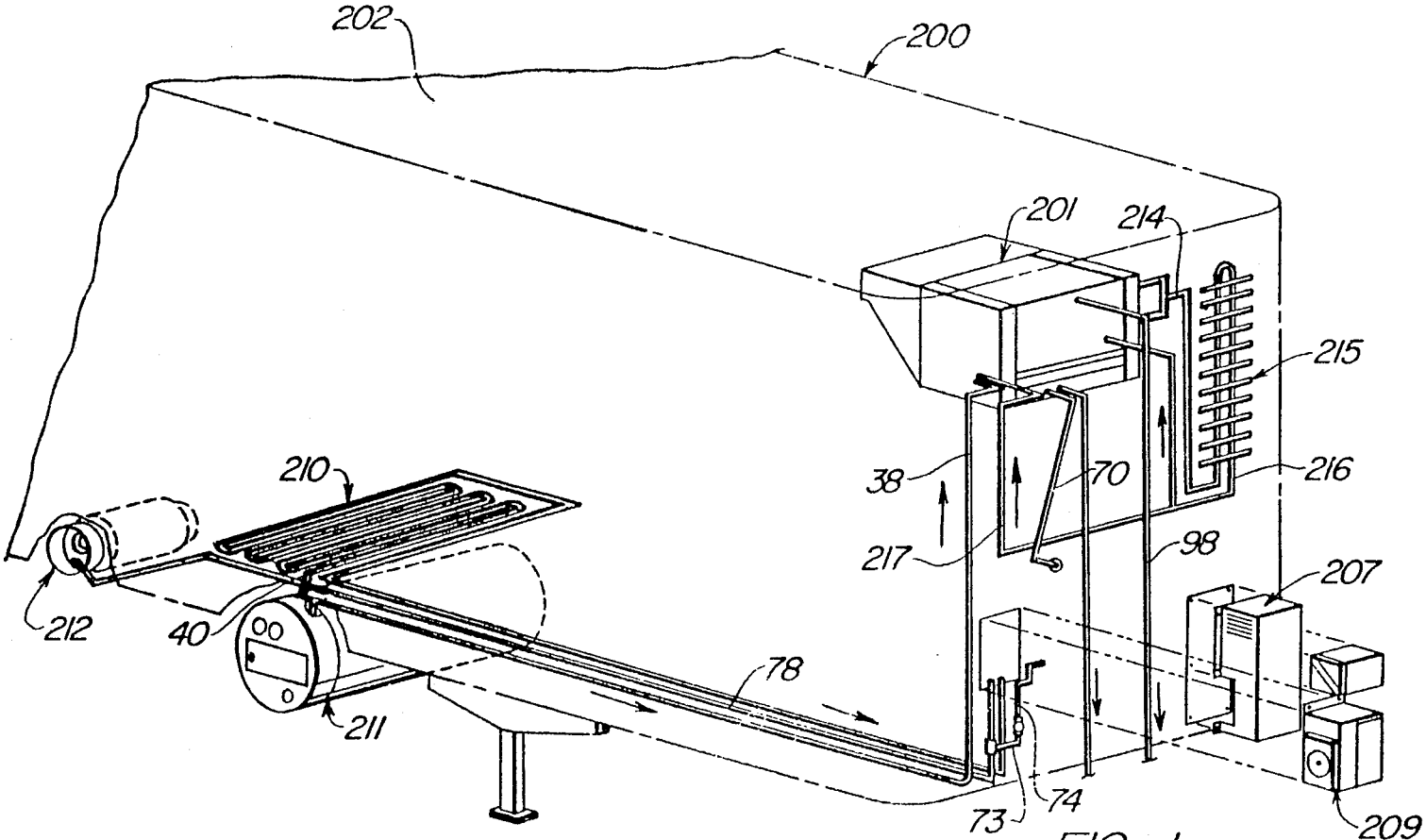
FIG. 1 is a diagrammatic perspective view of a transport vehicle illustrating a typical distribution of the components of the liquid carbon dioxide refrigeration apparatus installed thereon.
Figure 2:
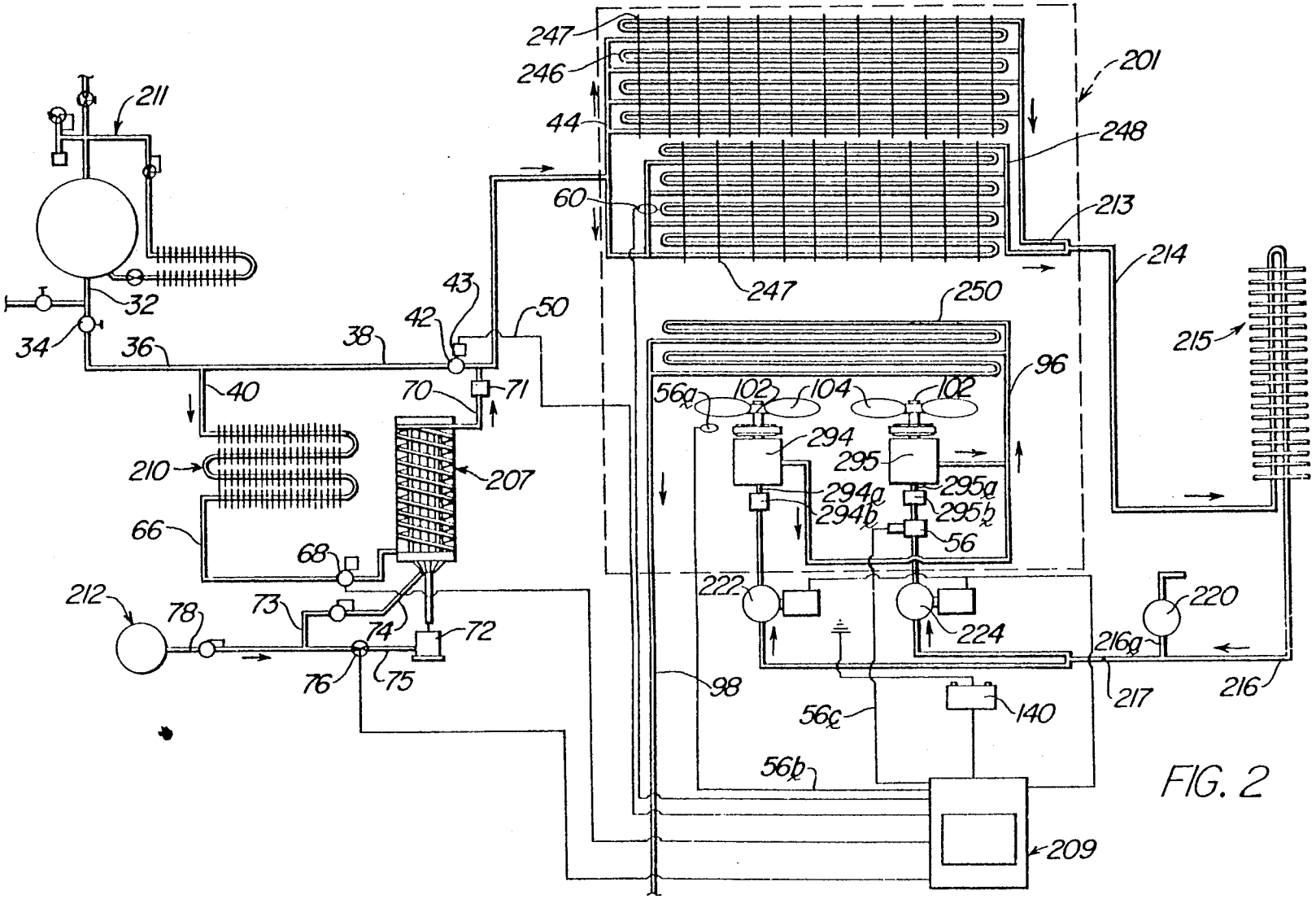
FIG. 2 is a schematic diagram of the liquid carbon dioxide refrigeration apparatus.

Referring to FIGS. 1 and 2 of the drawing the numeral 200 generally designates a vehicle having the carbon dioxide refrigeration system mounted therein for cooling an interior cargo compartment to subfreezing temperatures.

The refrigeration system includes an evaporator 201 connected to a source 211 of liquid carbon dioxide, and a controller 209 supplied with power by a battery 140. The refrigeration system incorporates apparatus for heating the cargo compartment which includes a source of fuel, such as tank 212 of propane, ethanol or liquified natural gas, connected to a heating unit 207. Liquid carbon dioxide is delivered through a vaporizer 210 to the heating unit 207 which delivers heated carbon dioxide through the coils of evaporator 201 for defrosting coils of the evaporator or for circulating warm air through the cargo compartment if heating is required.

A heat exchanger 215, mounted on the outside of the vehicle, is connected to the evaporator 201 for controlling the enthalpy of carbon dioxide vapor exhausted from the heat exchanger 201 and delivered to pneumatically driven motors. When the high pressured carbon dioxide vapor is exhausted through the motors 294 and 295 and the secondary cooling coil 250, it has been depressurized in the chambers of the pneumatic motors and provides about four to eight BTUs of additional cooling capacity per pound of carbon dioxide. This is a form of isentropic expansion. However, when the vapor depressurizes, it becomes very cold and if the pressure drop is excessive the carbon dioxide will solidify.

The enthalpy or heat content of a substance is a thermodynamic property defined as the internal energy plus the product of the pressure times the volume of the substance. If a substance undergoes a transformation from one physical state to another, such as a polymorphic transition, the fusion or sublimation of a solid, or the vaporization of a liquid, the heat absorbed by the substance during the transformation is defined as the latent heat of transformation. The heat absorbed by liquid carbon dioxide during the transformation from a liquid state to a vapor or gaseous state is generally referred to as the latent heat of vaporization.

Carbon dioxide has been used for the refrigerant in air conditioning installations and for food preservation on shipboard, but its high operating pressure and low critical temperature have been very objectionable. Carbon dioxide is non-toxic and has the lowest coefficient of performance of any of the general refrigerants.

The entropy, the relative disorder of the motion of the molecules, of a substance is a state property which has no outward physical manifestation such as temperature or pressure. Any process during which there is no change of entropy is said to be "isentropic."

Liquid carbon dioxide is delivered through a feed line 36 and distribution manifold 44 to an evaporator 201. In the embodiment of the evaporator 201 illustrated in FIG. 2 of the drawing, a pair of primary cooling coils 246 and 248 is illustrated which form a first heat exchanger. The primary cooling coils 246 and 248 preferably have heat conductive surface fins 247 to provide a substantial surface area for transfer of heat between air circulating over the outer surface of the coils and carbon dioxide vapor flowing through the coils. Liquid $CO_2$ vaporizes in the primary cooling coils 246 and 248 as heat is absorbed from the air circulating over the coils and pressurized $CO_2$ vapor is exhausted to a heat exchanger 215 mounted outside of the cargo compartment where the $CO_2$ vapor is warmed further to a temperature which will preclude solidification of the $CO_2$ in the system as will be hereinafter more fully explained.

The warmed carbon dioxide vapor, the maximum pressure of which is controlled by a pressure relief valve 220, is delivered through flow control orifices **294*b* and 295*b* to the inlets of at least one fluid driven motors 294 and 295. The outlet of each fluid driven motor 294 and 295 is connected to a secondary cooling coil 250** which is a second heat exchanger which exhausts to atmosphere outside the compartment in the vehicle.

Improvements in the system include heat exchanger 215, mounted outside the vehicle to modify or control the enthalpy and entropy of the carbon dioxide by warming the $CO_2$ gas after it leaves the finned primary cooling coils 246 and 248 and before it reaches the pneumatic motors 294 and 295, through pressure controlled $CO_2$ lines 216 and 217. The external heat exchanger 215, solenoid actuated flow control valves 222 and 224 and pressure relief valve 220 control the temperature and pressure of the $CO_2$ to assure that the $CO_2$ does not solidify when its pressure drops to near atmospheric pressure as it is delivered through the pneumatic motors 294 and 295, through the secondary coil 248, to atmosphere. The pressure relief valve 220 and solenoid actuated flow control valves 222 and 224 keep the system pressurized to a pressure of at least 65 psig to prevent the $CO_2$ from going to a solid when the system cycles off. As will be hereinafter more fully explained, sensors 56 and 60 initiate a defrost cycle when the temperature of $CO_2$ delivered to motor 295 is too low and terminate the defrost cycle when the surface of primary coils 246 and 248 increase to a a predetermined temperature.

The source 211 of cryogenic gas is of conventional design and preferably comprises an insulated container having an outer shell and an inner shell spaced by a vacuum chamber. Liquid carbon dioxide and a volume of carbon dioxide vapor above the liquid carbon dioxide fill the container. A conventional pressure building system, which includes a pressure building valve connected through a vaporizer and pressure regulator valve to an upper portion of the tank, permits a small quantity of the liquid $CO_2$ to boil off to maintain a constant supply pressure of approximately 80 to 85 PSI (pounds per square inch) and a temperature about −60 degrees F.

Liquid carbon dioxide is delivered through an insulated tube 32, flow control valve 34 and line 36 to branch lines 38 and 40.

In the particular embodiment of the invention illustrated in FIG. 1, the evaporator 201 is secured to an upper portion of front end wall of the transport 200 and is arranged to force cooled air through a plurality of air ducts (not shown) of varying lengths such that cooled air is distributed uniformly throughout the cargo compartment 202.

To provide a defrost and heating capability, the source of cryogenic gas 211 is connected through a vaporizer 210, preferably disposed outside the refrigerated cargo area 202, to a heating device 207. Heated vapor from heating device 207 is delivered through conduit 70 and a flow control orifice 71 to coils of evaporator 201 for defrosting the system and for causing heating air to be delivered through the cargo compartment if heating is required.

A controller 209, preferably mounted on the front of the transport 200 controls cooling, heating, defrosting and idle phases to maintain the set temperature. It controls the flow of both hot and cold vapor through coils 246 and 248 of evaporator 201 and an indicator (not shown) is connected to suitable temperature sensing means inside cargo compartment 202 for providing a visual indication of the temperature therein.

Branch line 38 is connected through a solenoid actuated liquid feed valve 42 and inlet manifold 44 to primary coils 246 and 248 of evaporator 201.

The flow passage through liquid feed valve 42 is controlled by suitable actuating means 43 connected to a valve element in the body of the valve. Actuator 43 is preferably a solenoid having a movable element disposed therein such that a signal delivered through line 50 causes the movable element to move thereby shifting a valve element for controlling flow through liquid feed valve 42. Line 50 is connected to temperature controller 209.

Temperature controller 209 is of conventional design and preferably comprises a temperature sensor **56*a* connected through line 56*b* to control apparatus of the controller 209 to indicate the temperature of air circulating through the cargo compartment 202 and across evaporator 201. A signal from controller 209 through line 50 holds liquid feed valve 42 open so long as sensor 56*a* is maintained at a temperature higher than that set on a programmable thermostat in the controller, when the control is set for cooling. Controller 209 preferably has a visual indicator associated therewith to indicate the temperature of air in the cargo compartment 202** and has temperature recording apparatus associated therewith (not shown) for plotting temperature in relation to time. Such instruments are commercially available from the Partlow Corporation of New Hartford, N.Y.

During a cooling cycle liquid carbon dioxide passes through branch line 38, liquid feed valve 42, and inlet manifold 44 to the primary coils 246 and 248 of evaporator 201. Since liquid carbon dioxide is rather difficult to vaporize (to change from liquid to gas) within the evaporator coils 246 and 248 the coil surface area has been increased by anodized aluminum fins 247 to increase the efficiency of heat transfer between air circulating across the coils and carbon dioxide flowing through the coils.

For defrosting primary coils 246 and 248, motors 246 and 248, and secondary coil 250 of evaporator 201, controller 209 closes feed valve 42 and opens valve 68 so that liquid carbon dioxide is routed through branch line 40 to vaporizer 210. The vaporizer 210 is exposed to ambient atmosphere outside of the cargo compartment 202 to provide sufficient heating to vaporize the liquid carbon dioxide. Vapor from vaporizer 210 passes through line 66 and solenoid actuated valve 68 to the heating device generally designated by numeral 207. Heated vapor passing from heating device 207 passes through line 70, having a flow control orifice 71 mounted therein, to evaporator 201.

The heating device 207 comprises a burner 72 and a pilot light 74 connected through lines 73 and 75, respectively, to a gas supply valve 76. A suitable fuel, such as propane, is delivered through line 78 from tank 212.

Below 62 psig. (pounds per square inch gauge), liquid carbon dioxide changes to a solid state (dry ice). To avoid this, the pressure builder maintains the pressure of tank 211 of $CO_2$ at a pressure higher than 60 psig and a pressure relief valve 220 is mounted between the primary coils 246 and 248 and the air motors 294 and 295. The pressure regulator 220 maintains pressure above 61 psig within the primary coils 246 and 248 of evaporator 201.

The pressure relief valve 220 communicates with conduit 216 through which carbon dioxide vapor flows from the heat exchanger 215, mounted outside cargo compartment 202, and conduit 217. Fluid from conduit 216 is delivered through a conduit **216*a* to pressure relief valve 220. The inlet opening of solenoid actuated flow control valve 222 is connected through conduit 217 to conduit 216 which delivers carbon dioxide vapor from the heat exchanger 215 and the outlet of the solenoid actuated flow control valve 222 is connected to the inlet 294*a* of pneumatically driven motor 294. Similarly, the inlet opening of solenoid actuated flow control valve 224 is connected to the conduit 216 which delivers carbon dioxide vapor from the heat exchanger 215 and the outlet of the solenoid actuated flow control valve 224 is connected to the inlet 295*a* of pneumatically driven motor 295. Flow limiting orifices 294*b* and 295*b* are mounted in the inlet 294*a* and 295*a* to each of the motors 294 and 295 to compensate for the high operating pressure of about 65 psig of the carbon dioxide vapor. These orifices balance the flow rate of liquid carbon dioxide to each of the primary cooling coils 246 and 248 and the flow of vapor from heat exchanger 215 to the motors 294 and 295**.

A sensor 56 is positioned to generate a signal proportional to the temperature of $CO_2$ delivered to the inlet **295*a* of motor 295**. The signal is delivered through line 56*c* to controller 209 to initiate a defrost cycle when required to clear insulating frost from coils of evaporator 201.

The outlet passages of motors 294 and 295 are connected through a line 96 a secondary coil 250 of evaporator 201, said secondary coil being connected to line 98 through which carbon dioxide vapor is exhausted to atmosphere outside the cargo compartment 202 of the vehicle.

Each pneumatic motor 294 and 295 has a shaft 102 on which a fan blade 104 is mounted such that the flow of carbon dioxide vapor through pneumatic motors 294 and 295 cause fan blades 104 to rotate causing air within the cargo compartment 202 of vehicle 200 to pass across the primary coils 246 and 248 and the secondary coil 250 of evaporator 201.

When the programmable thermostat of temperature controller 209 calls for cooling, an indicator light (not shown) is illuminated and solenoid actuated liquid feed valve 42 is held open, delivering liquid $CO_2$ to primary coils 246 and 248 until the temperature in the cargo compartment sensed by sensor 56*a* causes controller 209 to close liquid feed valve 42 and to close solenoid actuated valves 222 and 224 to hold pressure in coils 246 and 248.

When controller 209 calls for defrosting, an indicator light (not shown) is illuminated, valve 68 is opened, to route liquid $CO_2$ through vaporizer 210 to the heating device 207, and the burner 72 is turned on.

During heat and defrost cycles feed valve 42 is closed by a signal delivered through line 50 from controller 209.

OPERATION

The operation and function of the apparatus hereinbefore described is as follows:

A main power switch is moved to the "cool and heat" position for energizing control circuits in controller 209.

If the thermostat of temperature controller 209 is calling for a cooling cycle, electrical current is directed to a lamp to provide visual indication that cooling is required and liquid carbon dioxide flows through line 32, valve 34, line 36, branch line 38, liquid feed valve 42 and inlet manifold 44 into the primary coils 246 and 248 of evaporator 201. The liquid carbon dioxide is at a temperature of approximately −60° F. and as heat is absorbed through the walls of primary coils 246 and 248 air adjacent thereto is cooled. Carbon dioxide from primary coils 246 and 248 passes through an exhaust manifold 213 and conduit 214 for driving pneumatic motors 294 and 295 causing fans 104 to circulate air across the primary and secondary coils. Carbon dioxide exhausted from motors 294 and 295 passes through line 96 to secondary coils 250 to absorb as much heat as possible before being exhausted through line 98 to ambient atmosphere. It should be readily apparent that no carbon dioxide passes into the cargo compartment of the vehicle.

As ice forms on coils 246 and 248 of the evaporator 201, the rate of heat transfer through walls of the coils is reduced. When the temperature of the $CO_2$ coming into the motors 294 and 295 drops to a temperature of for example, minus 70° F. a defrost cycle is initiated by sensor 56.

When the circuit calls for a defrost cycle the coil 43 of solenoid actuated valve liquid feed valve 42 closes valve 42 stopping the flow of liquid carbon dioxide to primary cooling coils 246 and 248 of evaporator 201.

The $CO_2$ is routed through the vaporizer 210 to the heater 207 and then delivers the hot $CO_2$ vapor through the primary coils 246 and 248 for defrosting.

When surface mounted sensor 60 on primary coil 248 indicates that the temperature of the surface of coil 248 has increased to for example −60° F. it terminates the defrost cycle.

The sensor 56 is located in the stream so that the $CO_2$ that's coming into the air motor 295 flows across this temperature sensor. If $CO_2$ flowing to the inlet of motor 295 is too cold, for example less than −70 degrees F. a defrost cycle is initiated.

It should be appreciated that the intense heat of vapor delivered from the heating device 207 results in very rapid melting of ice on surfaces of the coils 246 and 248 of evaporator 201 and on the surfaces of motors 294 and 295. Although motors 294 and 295 are running during the defrost cycle, the defrost cycle is so short that the cargo compartment is not heated appreciably.

The system is completely automatic employing thermostat control means to initiate cooling and heating cycles and employing means for sensing a temperature measurement for terminating both.

It should be appreciated that other and further embodiments of the invention may be devised without departing from the basic concept of the invention.

Having thus described the invention, I claim:

1. A method of refrigerating air in a compartment comprising the steps of:

delivering liquid carbon dioxide through an evaporator means such that sufficient heat is absorbed from the air in the compartment to evaporate the liquid carbon dioxide to form a pressurized vapor;

heating the pressurized carbon dioxide vapor that is exhausted from the evaporator means to prevent solidification of the carbon dioxide when the pressure is reduced to atmospheric pressure; and depressurizing the carbon dioxide vapor to provide isentropic expansion of the vapor into a heat exchanger means so that additional heat is absorbed from the air in the compartment.

2. A method of controlling the heat transfer rate through a wall of a tube in a compartment comprising the steps of:

delivering liquid carbon dioxide into the tube;

moving fluid in the compartment in heat exchange relation with the tube such that heat of the fluid is absorbed by the carbon dioxide to form pressurized carbon dioxide vapor in the tube;

circulating the pressurized carbon dioxide vapor out of the compartment;

heating the pressurized carbon dioxide vapor;

delivering the heated carbon dioxide vapor to drive a pneumatic motor driven fan to move the fluid in the compartment in heat exchange relation with the tube; and controlling the flow of heated carbon dioxide vapor to the pneumatic motor to prevent solidification of the carbon dioxide as the carbon dioxide depressurizes upon reaching the pneumatic motor chambers.

3. The method of claim 2, with the addition of the steps of: sensing temperature of carbon dioxide exhausted from the tube; and heating surfaces of the tube when the temperature of carbon dioxide flowing to the motor driven fan is less than a predetermined temperature.

4. The method of claim 3 wherein the step of sensing temperature of carbon dioxide is accomplished by positioning a temperature sensor in heat exchange relation with carbon dioxide flowing to the motor.

5. The method of claim 3 wherein the step of heating surfaces of the tube comprises: heating a volume of carbon dioxide; and delivering the heated carbon dioxide through the tube.

6. The method of claim 5 with the addition of the steps of: sensing the temperature of the surface of the tube; and terminating heating of the surfaces of the tube when the tube surface increases to a predetermined temperature.

7. A method of controlling temperature in a compartment comprising the steps of:

circulating liquid carbon dioxide through a primary coil such that the carbon dioxide absorbs heat;

changing the enthalpy of the carbon dioxide by heating the carbon dioxide exhausted from the primary coil to assure that the carbon dioxide is in a vapor phase;

delivering the heated carbon dioxide vapor through a pneumatic motor arranged to drive a fan; and circulating the carbon dioxide exhausted from the motor through a secondary coil, the primary and secondary coils being positioned such that the motor moves air within the compartment in heat exchange relation with the coils.

8. The method of claim 7 with the addition of the steps of:

stopping the flow of the liquid carbon dioxide to the primary coil when a predetermined quantity of ice has formed on surfaces of the primary coil; and directing heated carbon dioxide vapor through the primary coils, through the motor, and through the secondary coil for melting ice on the surfaces of the primary coil.

9. Temperature control apparatus comprising:

a coil;

means to deliver pressurized fluid carbon dioxide through said coil so that the carbon dioxide absorbs heat from the atmosphere surrounding said coil to form pressurized carbon dioxide vapor;

means for heating the pressurized carbon dioxide vapor that is exhausted from said coil to prevent solidification of the carbon dioxide when the pressure is reduced to atmospheric pressure;

depressurizing the heated carbon dioxide vapor to provide isentropic expansion of the vapor into heat exchanger means so that additional heat is absorbed from the atmosphere surrounding said coil;

means to move the surrounding atmosphere across said coil;

first sensor means to sense temperature of carbon dioxide exhausted from said coil;

second sensor means to sense the temperature of the surface of said coil;

means to generate a signal when the temperature of the carbon dioxide exhausted form said coil is less than a predetermined temperature;

means energized by the signal to heat surfaces of said coil to melt ice thereon; and means energized by said second sensor to terminate heating of the surfaces of said coil.

10. The combination called for in claim 9 wherein the means to move air across said coil comprisers: a fluid driven motor connected in driving relation with impeller means; and means to direct fluid from said coil through the motor.

11. Temperature control apparatus according to claim 10 with the addition of orifice means adjacent the inlet to said fluid driven motor.

12. Temperature control apparatus according to claim 11 with the addition of flow control valve means in said means to direct fluid through said motor.

13. The combination called for in claim 9 wherein the means energized by the signal to heat the surfaces of said coil comprises:

heater means;

signal responsive valve means arranged to deliver carbon dioxide to the heater means; and means to deliver heated carbon dioxide from the heater means to said coil.

14. The combination called for in claim 9 wherein the means to deliver fluid through the coil comprises: a container; conduit means connected between said container and the coil; and means in said conduit means for controlling the flow of carbon dioxide therethrough.

15. Apparatus to control temperature in a cargo compartment of a trailer comprising:

a source of liquefied carbon dioxide carried by the trailer;

an evaporator means in the compartment;

said evaporator means for causing the liquefied carbon dioxide to absorb sufficient heat from within the compartment so that the liquefied carbon dioxide is evaporated to form pressurized carbon dioxide vapor, first conduit means connecting said evaporator means and said source of liquefied carbon dioxide;

heat exchanger means;

second conduit means connecting said heat exchanger means with said evaporator means; and a pneumatically operated motor;

a fan mounted to be driven by said motor, said fan arranged to cause air in the compartment to circulate over the surfaces of said evaporator means;

third conduit means connecting said heat exchanger means with said motor; said motor being driven by the release of the pressurized carbon dioxide vapor to atmospheric pressure, and said heat exchanger means for heating the carbon dioxide sufficiently to prevent solidification of the carbon dioxide when the carbon dioxide becomes depressurized in said motor.

16. The combination called for in claim 15 with the addition of: temperature sensor means adapted to sense the temperature of vapor delivered to said motor; and controller means adapted to defrost said evaporator when the temperature of vapor drops to near the freezing point of carbon dioxide.

* * * * *

UNITED STATES PATENT AND TRADEMARK OFFICE

CERTIFICATE OF CORRECTION

PATENT NO. : 5,069,039

DATED : December 3, 1991

INVENTOR(S) : Patrick S. Martin

It is certified that error appears in the above-identified patent and that said Letters Patent is hereby corrected as shown below:

Col. 9, line 61, change "form" to read -- from -- .

Signed and Sealed this

Ninth Day of March, 1993

*Attest:*

STEPHEN G. KUNIN

*Attesting Officer*

*Acting Commissioner of Patents and Trademarks*